US010724698B2

(12) United States Patent
Ano et al.

(10) Patent No.: US 10,724,698 B2
(45) Date of Patent: Jul. 28, 2020

(54) LIGHT SOURCE UNIT FOR LIGHTING TOOL FOR VEHICLE AND LIGHTING TOOL FOR VEHICLE

(71) Applicant: STANLEY ELECTRIC CO., LTD., Tokyo (JP)

(72) Inventors: Koichiro Ano, Tokyo (JP); Norifumi Imazeki, Tokyo (JP); Nobuo Kato, Tokyo (JP); Masakazu Inoue, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/273,959

(22) Filed: Feb. 12, 2019

(65) Prior Publication Data

US 2019/0257489 A1 Aug. 22, 2019

(30) Foreign Application Priority Data

Feb. 20, 2018 (JP) ..... 2018-027716

(51) Int. Cl.

| | |
|---|---|
| ***F21S 41/19*** | (2018.01) |
| ***F21S 43/19*** | (2018.01) |
| ***F21V 29/70*** | (2015.01) |
| ***F21S 45/48*** | (2018.01) |
| *F21Y 115/10* | (2016.01) |

(Continued)

(52) U.S. Cl.

CPC ..... *F21S 41/192* (2018.01); *F21S 43/195* (2018.01); *F21S 45/48* (2018.01); *F21V 29/70* (2015.01); *F21S 41/141* (2018.01); *F21S 43/14* (2018.01); *F21Y 2115/10* (2016.08)

(58) Field of Classification Search

CPC ..... F21S 41/192; F21S 41/141; F21S 43/195; F21S 43/14; H05K 5/0026; H05K 5/0069

See application file for complete search history.

(56) References Cited

U.S. PATENT DOCUMENTS

2015/0016136 A1 1/2015 Nakano et al.
2016/0059767 A1* 3/2016 Kwak ..... B60Q 1/2638 362/520

FOREIGN PATENT DOCUMENTS

EP 2 345 836 A2 7/2011
JP 2008-078013 A 4/2008

(Continued)

OTHER PUBLICATIONS

Extended European Search Report for the related European Patent Application No. 19157481.3 dated May 10, 2019.

*Primary Examiner* — Timothy J Thompson
*Assistant Examiner* — Amol H Patel
(74) *Attorney, Agent, or Firm* — Kenealy Vaidya LLP

(57) ABSTRACT

A light source unit for a lighting tool for a vehicle includes a circuit board on which a light emitting element is provided and a socket main body having a board attachment section to which the circuit board is attached and a connector section electrically connected to the circuit board via lead terminals, wherein the board attachment section has a fixing terminal configured to fix the circuit board, and the circuit board has first hole sections, into which the lead terminals are inserted, and a second hole section, into which the fixing terminal is inserted, and is attached to the board attachment section by the lead terminals being fixed to a periphery of the first hole sections and the fixing terminal being fixed to a periphery of the second hole section.

8 Claims, 7 Drawing Sheets

(51) Int. Cl.
*F21S 43/14* (2018.01)
*F21S 41/141* (2018.01)

(56) References Cited

FOREIGN PATENT DOCUMENTS

| | | | | |
|---|---|---|---|---|
| JP | 2008078013 | A | * | 4/2008 |
| JP | 2012-038698 | A | | 2/2012 |
| JP | 2012038698 | A | * | 2/2012 |
| JP | 2013-025935 | A | | 2/2013 |
| JP | 2015-220034 | A | | 12/2015 |
| JP | 2016-143634 | A | | 8/2016 |
| JP | 2016-195098 | A | | 11/2016 |

* cited by examiner

LIGHT SOURCE UNIT FOR LIGHTING TOOL FOR VEHICLE AND LIGHTING TOOL FOR VEHICLE

CROSS-REFERENCE TO RELATED APPLICATION

Priority is claimed on Japanese Patent Application No. 2018-027716, filed Feb. 20, 2018, the content of which is incorporated herein by reference.

BACKGROUND OF THE INVENTION

Field of the Invention

The present invention relates to a light source unit for a lighting tool for a vehicle and a lighting tool for a vehicle.

Description of Related Art in recent years, in a lighting tool for a vehicle, high luminance and reduction in cost of a light emitting diode (LED) is achieved, and thus, employment of the LEDs in light sources is being gradually increased. The LED has a merit such as low power consumption for a long lifetime.

For example, a light source unit in which a socket with a coupler on which an LED is mounted is detachably attached to an attachment hole is provided on a back surface side of a lighting body has been proposed (for example, see Japanese Unexamined Patent Application, First Publication No. 2016-195098). Such a light source unit is appropriately used as an exchangeable (replaceable) light source such as a tail lamp for a vehicle or the like configured to emit red light.

SUMMARY OF THE INVENTION

Incidentally, in the light source unit disclosed in Japanese Unexamined Patent Application, First Publication No. 2016-195098, a configuration in which a board on which an LED is mounted is fixed to a socket housing (a socket main body) formed integrally with a heat radiation plate using an adhesive agent is provided. However, in the case of the configuration, in a curing process of the adhesive agent, equipment such as a curing oven or the like is required. In addition, machining man-hours until the adhesive agent is cured is required. Accordingly, in a configuration in which a board is fixed to a socket housing using such an adhesive agent, manufacturing costs are increased.

An aspect of the present invention provides a light source unit for a lighting tool for a vehicle capable of stably attaching a circuit board to a socket main body while performing reduction in manufacturing costs, and a lighting tool for a vehicle including such a light source unit for a lighting tool for a vehicle.

A light source unit for a lighting tool for a vehicle according to an aspect of the present invention includes a circuit board on which a light emitting element is provided and a socket main body having a board attachment section to which the circuit board is attached and a connector section electrically connected to the circuit board via a lead terminal, wherein the board attachment section has a fixing terminal configured to fix the circuit board, and the circuit board has a first hole section into which the lead terminal is inserted and a second hole section into which the fixing terminal is inserted and is attached to the board attachment section by the lead terminal being fixed to a periphery of the first hole section and the fixing terminal being fixed to a periphery of the second hole section.

In the aspect of the present invention, the circuit board may have a first land section around the first hole section, and the lead terminal may be fixed to the first land section through soldering.

In the aspect of the present invention, the circuit board may have a second land section around the second hole section, and the fixing terminal may be fixed to the second land section through soldering.

In the aspect of the present invention, the first hole section and the second hole section may be provided at positions so as to face each other with the light emitting element on the circuit board interposed therebetween.

In the aspect of the present invention, a heat sink configured to radiate heat emitted from the light emitting element may be provided on the socket main body.

A lighting tool for a vehicle according to another aspect of the present invention includes a light source unit for a lighting tool for a vehicle according to any one of the above-mentioned aspects.

In the aspect of the present invention, the light source unit for a lighting tool for a vehicle may be detachably attached to a lighting body.

According to the aspect of the present invention, it is possible to provide a light source unit for a lighting tool for a vehicle capable of stably attaching a circuit board to a socket main body while performing reduction in manufacturing costs, and a lighting tool for a vehicle including such a light source unit for a lighting tool for a vehicle.

DETAILED DESCRIPTION OF THE INVENTION

Figure 1:
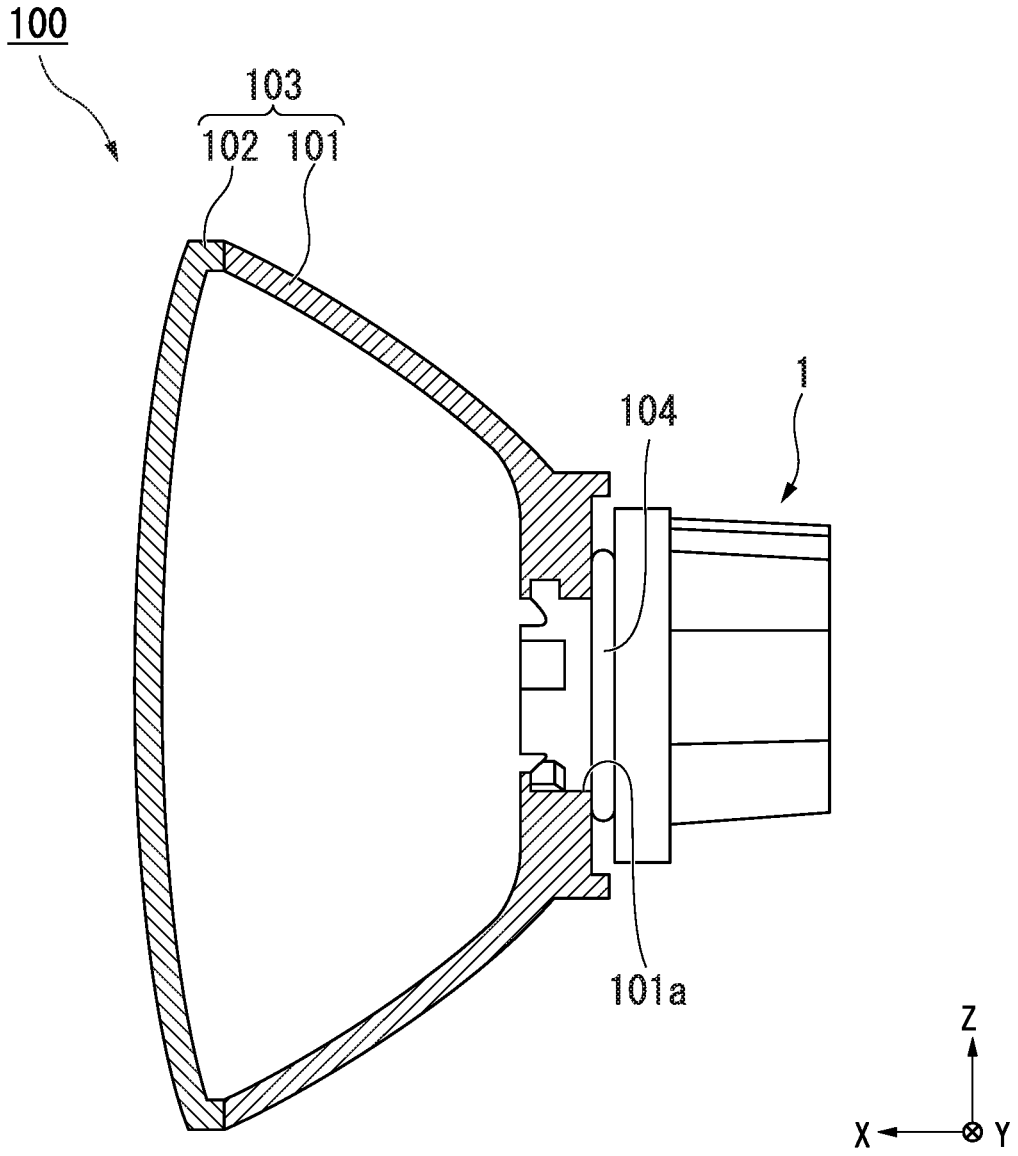
FIG. 1 is a cross-sectional view showing a configuration of a lighting tool for a vehicle including a light source unit for a lighting tool for a vehicle according to an embodiment of the present invention.

Hereinafter, an embodiment of the present invention will be described in detail with reference to the accompanying drawings.

Further, in the drawings used in the following description, in order to make components easier to see, there are cases where scales of dimensions are shown differently according to the components, and dimensional ratios or the like of the components are not necessarily the same as the actual.

As an embodiment of the present invention, for example, a lighting tool 100 for a vehicle including a light source unit 1 for a lighting tool for a vehicle (hereinafter, referred to as a light source unit) shown in FIG. 1 will be described. Further, FIG. 1 is a cross-sectional view showing a configuration of the lighting tool 100 for a vehicle including the light source unit 1.

In addition, in the drawings described as below, an XYZ orthogonal coordinate system is set, an X-axis direction is referred to as a forward/rearward direction (a lengthwise direction) of the light source unit 1 (the lighting tool 100 for a vehicle), a Y-axis direction is referred to as a leftward/rightward direction (a widthwise direction) of the light source unit 1 (the lighting tool 100 for a vehicle), and a Z-axis direction is referred to as an upward/downward direction (a height direction) of the light source unit 1 (the lighting tool 100 for a vehicle).

The lighting tool 100 for a vehicle of the embodiment is a lighting tool obtained by applying the present invention to tail lamps disposed at both corner sections of a rear end side of a vehicle (not shown) and configured to emit red light. In addition, the light source unit 1 of the embodiment is a socket with a coupler on which an exchangeable (replaceable) LED lamp is mounted.

Further, directions of forward, rearward, leftward, rightward, and so on, in the following description mean directions when the lighting tool 100 for a vehicle (the light source unit 1) is seen from a front side of the lighting tool 100 (a rear side of the vehicle) unless the context clearly indicates otherwise. Accordingly, directions when the vehicle is seen from a front side of the vehicle (a front side of the vehicle) are directions in which directions of forward, rearward, leftward and rightward are reversed.

Specifically, as shown in FIG. 1, the lighting tool 100 for a vehicle has a configuration in which the light source unit 1 of the embodiment is accommodated in a lighting body 103 constituted by a housing 101 having a front side that is open and a transparent lens cover 102 configured to cover the opening of the housing 101.

The light source unit 1 can be detachably attached to a periphery of an attachment hole 101*a* via a ring-shaped backing (an O-ring) 104 in a state in which a front surface side thereof is inserted inside the lighting body 103 from the attachment hole 101*a* formed in the housing 101 (the lighting body 103) on a back surface (a rear surface) side.

Figure 2:
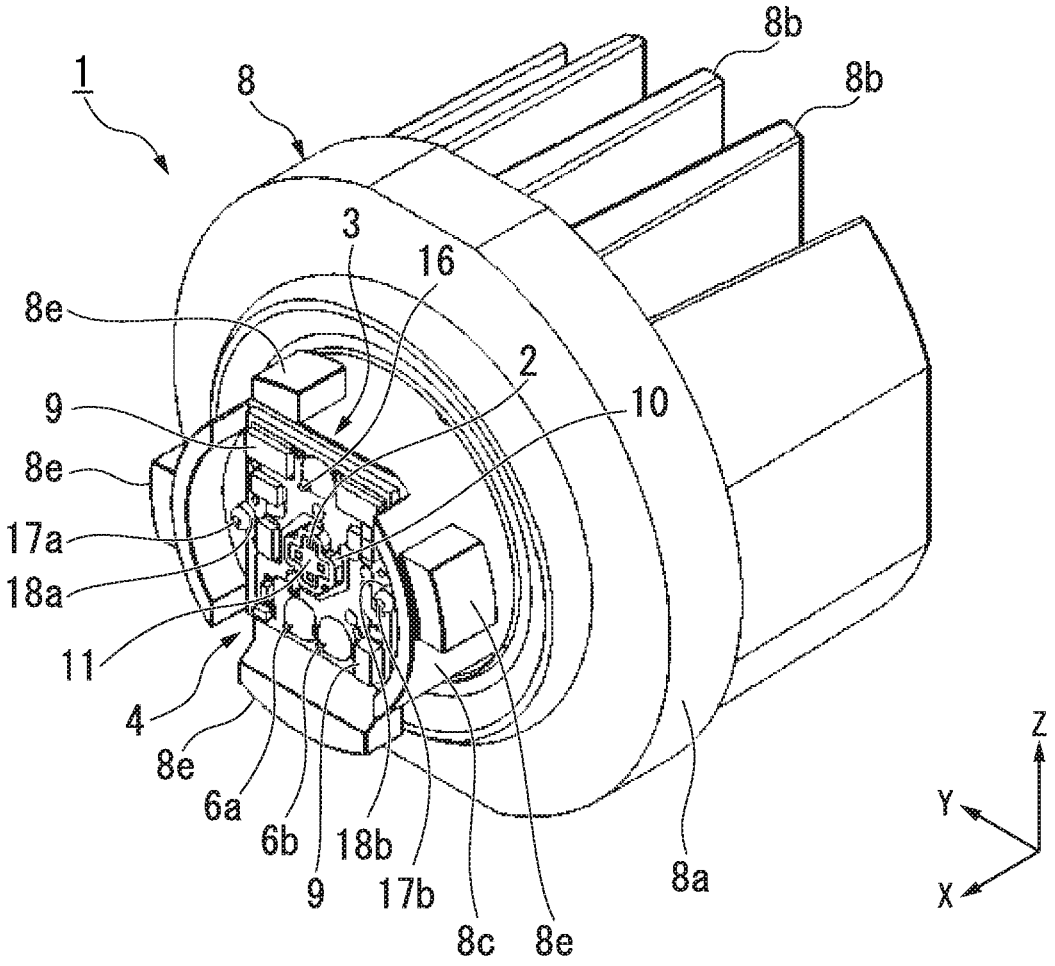
FIG. 2 is a perspective view showing the configuration of the light source unit for a lighting tool for a vehicle shown in FIG. 1.
Figure 3:
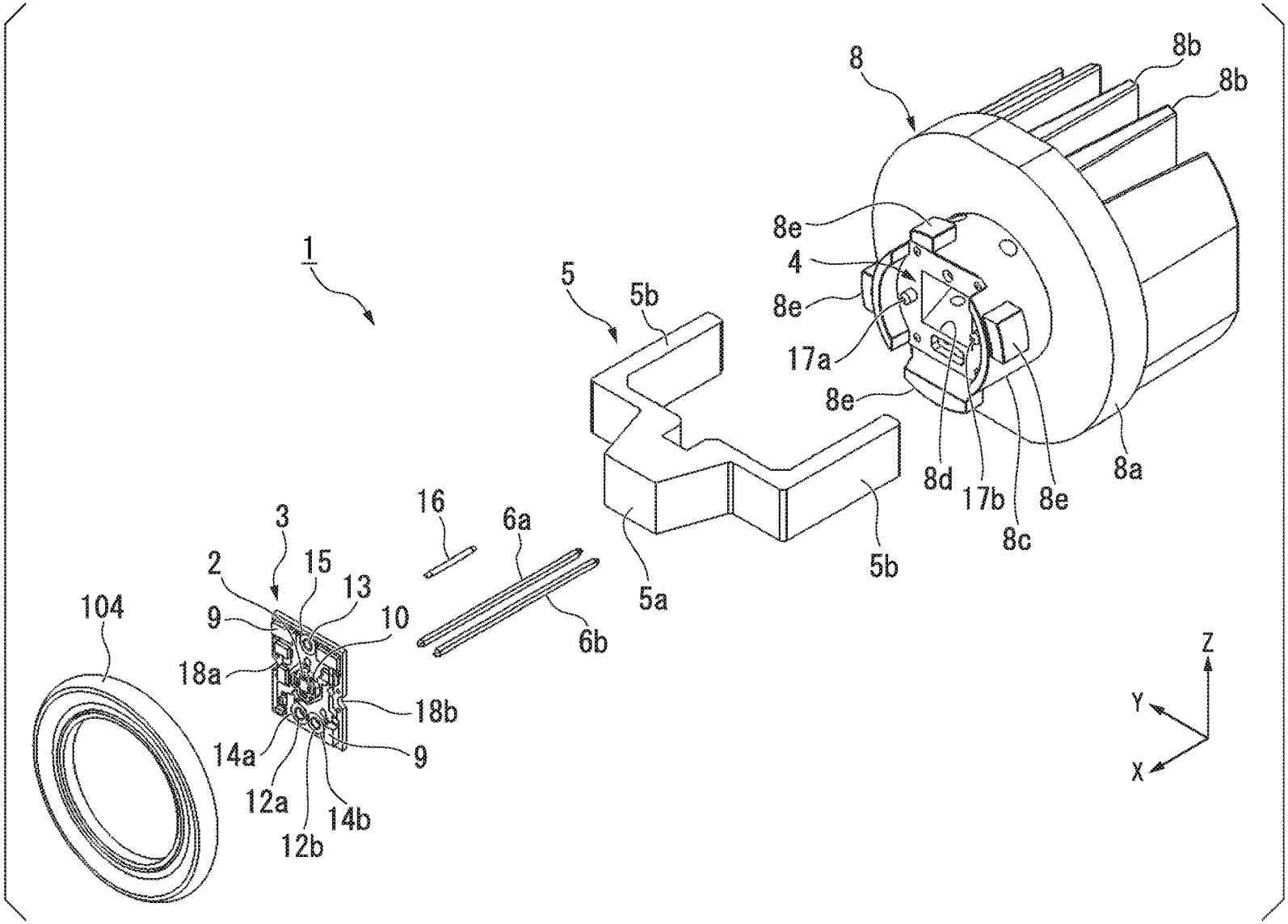
FIG. 3 is an exploded perspective view showing the configuration of the light source unit for a lighting tool for a vehicle shown in FIG. 1.
Figure 4:
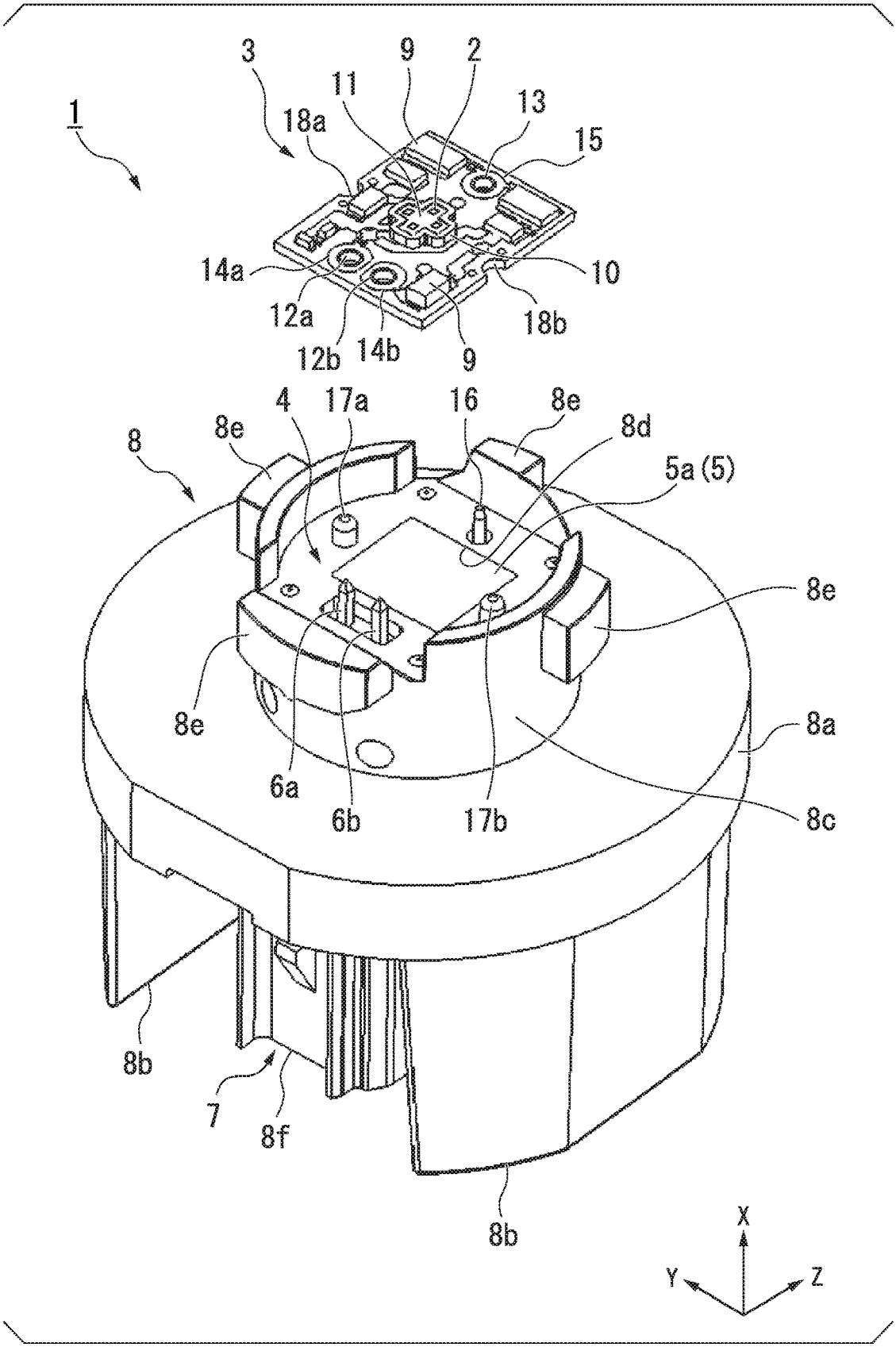
FIG. 4 is a perspective view showing a configuration of a circuit board and a socket main body of the light source unit for a lighting tool for a vehicle shown in FIG. 1.
Figure 5:
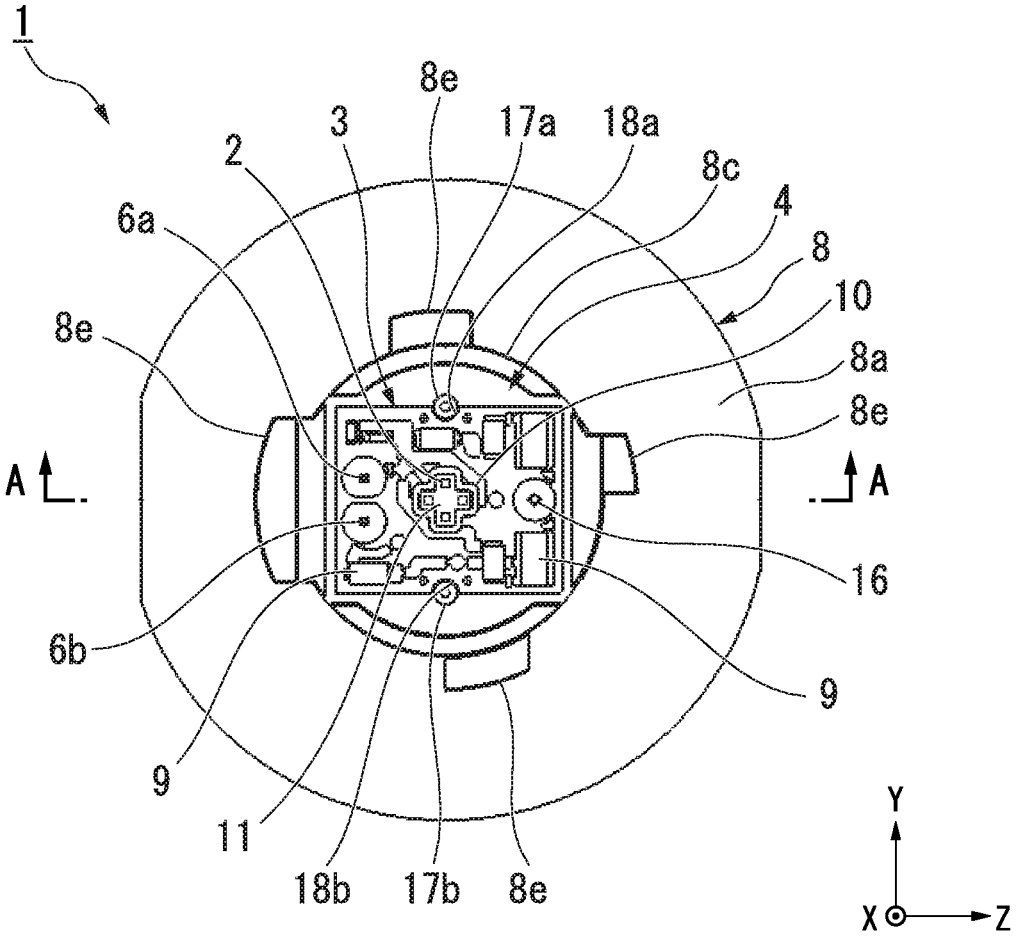
FIG. 5 is a front view showing the configuration of the light source unit for a lighting tool for a vehicle shown in FIG. 1.

Hereinafter, a specific configuration of the light source unit 1 of the embodiment will be described with reference to FIG. 2 to FIG. 7. Further, FIG. 2 is a perspective view showing a configuration of the light source unit 1. FIG. 3 is an exploded perspective view showing a configuration of the light source unit 1. FIG. 4 is perspective view showing a configuration of a circuit board 3 and a socket main body 8 of the light source unit 1. FIG. 5 is a front view showing a configuration of the light source unit 1.

Figure 6:
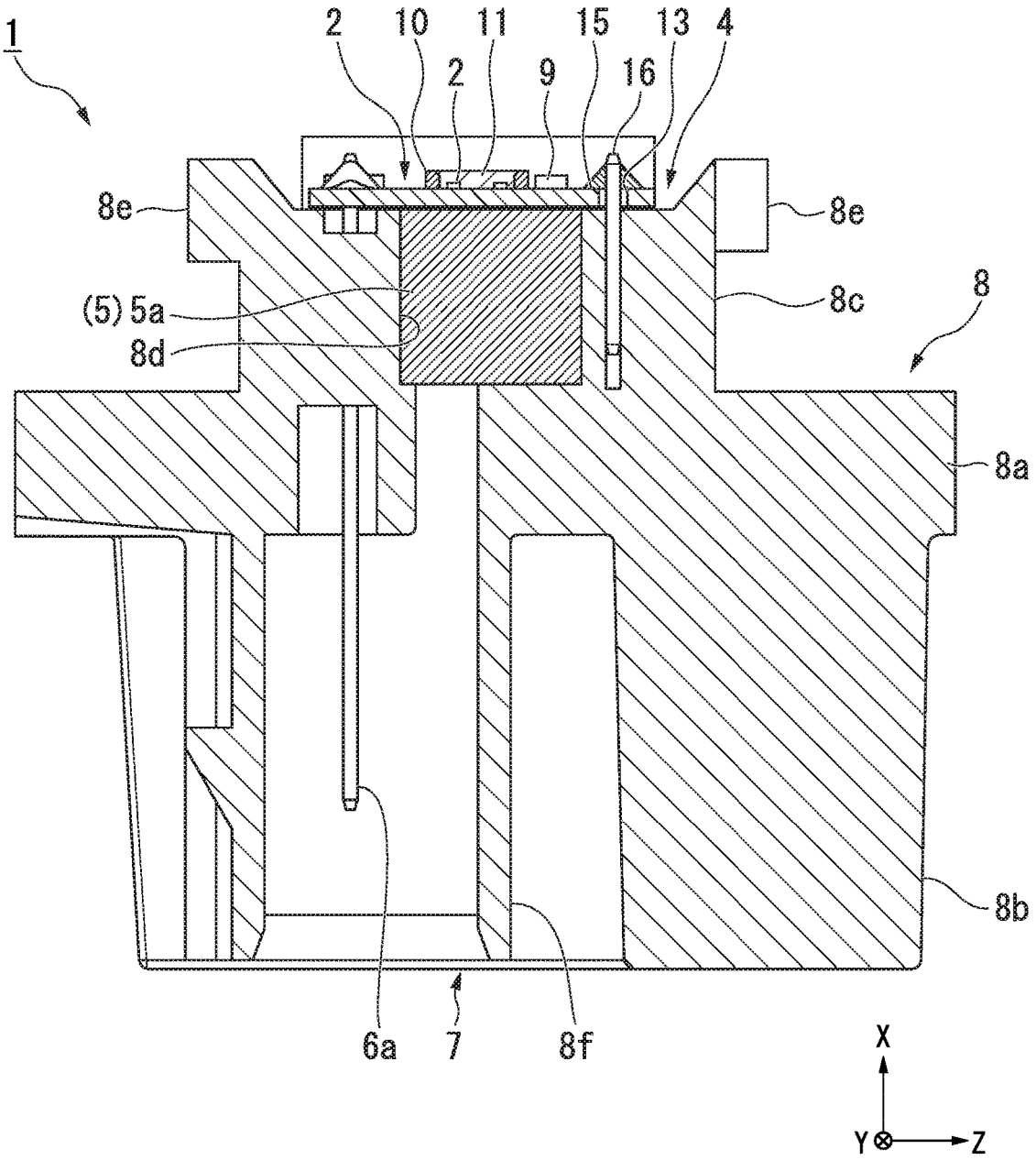
FIG. 6 is a cross-sectional view of the light source unit for a lighting tool for a vehicle taken along line A-A shown in FIG. 5.
Figure 7:
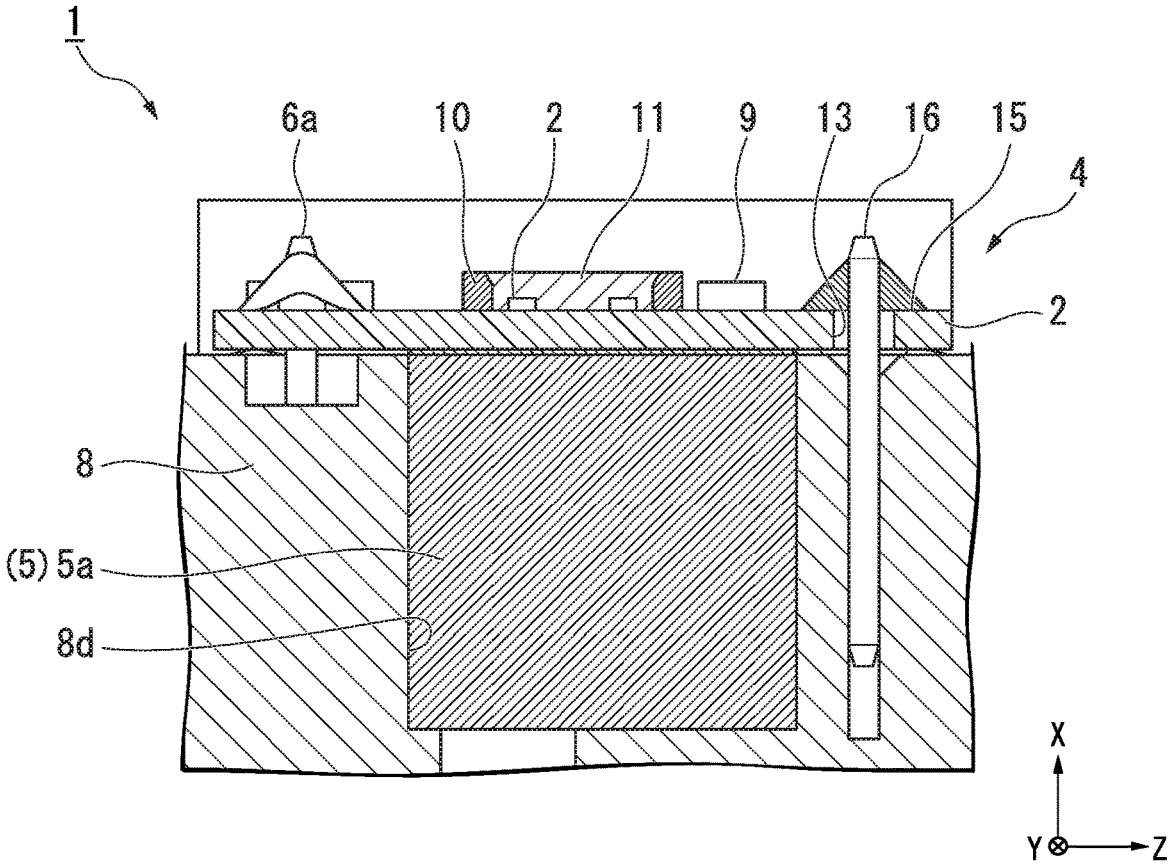
FIG. 7 is an enlarged cross-sectional view of a main part of the light source unit for a lighting tool for a vehicle shown in FIG. 6.

FIG. 6 is a cross-sectional view of the light source unit 1 taken along line A-A shown in FIG. 5. FIG. 7 is an enlarged cross-sectional view of a main part of the light source unit 1 shown in FIG. 6.

As shown in FIG. 2 to FIG. 7, the light source unit 1 of the embodiment generally includes the circuit board 3 on which a plurality of light emitting elements 2 are provided, a board attachment section 4 to which the circuit board 3 is attached, a heat sink 5 configured to radiate heat emitted from the light emitting elements 2, and the socket main body 8 on which a connector section 7 electrically connected to the circuit board 3 via the pair of lead terminals 6*a* and 6*b* is provided.

The plurality of light emitting elements 2 are constituted by chip LEDs (SMD LEDs) configured to emit red light (hereinafter, referred to as light). In addition, a high output type for vehicle illumination is used as the chip LED. Further, in the embodiment, four light emitting elements 2 are used. The four light emitting elements 2 are disposed to be respectively arranged at positions radially separated upward, downward, leftward and rightward from positions that become a center thereof (a substantially central section of the circuit board 3) in a substantially central section in a surface of the circuit board 3 at equal intervals.

The circuit board 3 is constituted by a printed wiring board (PWB) having a rectangular plate shape. The plurality of light emitting elements 2, a plurality of electronic parts 9 that constitute a driving circuit configured to drive the plurality of light emitting elements 2, and a reflector 10 configured to reflect light emitted from the plurality of light emitting elements 2 toward a front side are provided on a front side (a surface) of the circuit board 3. In addition, the reflector 10 is provided to surround the plurality of light emitting elements 2. A sealing resin 11 configured to seal the inside of the reflector 10 is provided in the reflector 10.

In addition, while not shown, a wiring configured to connect the plurality of light emitting elements 2 to each other in serial, a wiring configured to electrically connect the light emitting elements 2 and the electronic parts 9, a wiring configured to electrically connect the electronic parts 9 and the pair of lead terminals 6*a* and 6*b*, a bonding wire configured to electrically connect the light emitting elements 2 and the wiring, or the like, is provided on a front surface of the circuit board 3.

A pair of first hole sections 12*a* and 12*b*, which pass through the circuit board 3, and a second hole section 13 are provided in the circuit board 3. First land sections 14*a* and 14*b* that form a part of the wiring are provided around the first hole sections 12*a* and 12*b*. Meanwhile, a second land section 15 independent from the wiring is provided around the second hole section 13.

The pair of first hole sections 12*a* and 12*b* and the second hole section 13 are provided at positions facing each other with the light emitting elements 2 on the circuit board 3 interposed therebetween. In the embodiment, the pair of first hole sections 12*a* and 12*b* are disposed at a lower side of the light emitting elements 2, and the second hole section 13 is disposed at an upper side of the light emitting elements 2. In addition, a center of a region that connects the pair of first hole sections 12*a* and 12*b* and the second hole section 13 and a center of a circuit board substantially coincide with each other.

The light source unit 1 has a structure in which the heat sink 5 is attached integrally with the inside of the socket main body 8 through insert molding of the heat sink 5 formed of a metal material having a high thermal conductivity and the socket main body 8 formed of an insulating resin material having a high thermal conductivity.

Specifically, the heat sink 5 has a protrusion 5*a* having a substantially rectangular cross-sectional shape and protruding forward, and a pair of extension sections 5*b* extending in a direction in which they are separated from a base end side of the protrusion 5*a* and then bent toward a back surface side at a substantially right angle.

Meanwhile, the socket main body 8 has a front wall section 8*a* having a substantially circular cross-sectional shape, a plurality of radiation pins 8*b* provided to surround the connector section 7 from a back surface side of the front wall section 8*a*, a front cylindrical section 8*c* having a substantially circular cross-sectional shape and protruding forward from a substantially central section of the front wall section 8*a* on a front surface side, and a through-hole 8*d* having a substantially circular cross-sectional shape and passing through the front wall section 8*a* to an inner side of the front cylindrical section 8*c*.

In addition, a plurality of claw sections 8*e* serving as a detent and a stopper with respect to the attachment hole 101*a* are provided to be arranged on an outer circumferential surface of the front cylindrical section 8*c* in a circumferential direction. A packing 104 is attached to the front wall section 8*a* while coming in contact with the front wall section 8*a* in a state in which the packing 104 passes through the front cylindrical section 8*c*.

The connector section 7 has a socket section 8*f* having a substantially cylindrical shape and protruding rearward from a substantially central section of the front wall section 8*a* on a back surface side. The connector section 7 has the pair of lead terminals 6*a* and 6*b* arranged parallel to each other inside the socket section 8*f*. The lead terminals 6*a* and 6*b* are disposed on a lower side of the through-hole 8*d* and integrally attached to the socket main body 8 in a state penetrating through the front wall section 8*a* in the forward/rearward direction.

The board attachment section 4 is provided on a tip of the front cylindrical section 8*c*. The heat sink 5 is integrally attached to an inner side of the socket main body 8 in a state in which the protrusion 5*a* passes through the through-hole 8*d*. Accordingly, in the board attachment section 4, a tip of the protrusion 5*a* and a tip of the front cylindrical section 8*c* exposed from the through-hole 8*d* form flat surfaces that are continuous with each other.

In addition, the board attachment section 4 has a fixing terminal 16 protruding forward from a tip of the front cylindrical section 8*c*. The fixing terminal 16 is disposed on an upper side of the through-hole 8*d*, and integrally attached to the socket main body 8 in a state not penetrating through the front wall section 8*a* in the forward/rearward direction. The same material as the lead terminals 6*a* and 6*b* can be used in the fixing terminal 16. In addition, terminal shorter than the lead terminals 6*a* and 6*b* is used in the fixing terminal 16. Further, a cross-sectional shape of the lead terminals 6*a* and 6*b* and the fixing terminal 16 is not particularly limited and may be a circular shape or a polygonal shape.

In addition, the board attachment section 4 has a pair of positioning protrusions (positioning convex sections) 17*a* and 17*b* protruding forward from a tip of the front cylindrical section 8*c*. The pair of positioning protrusions 17*a* and 17*b* are provided at positions facing each other while being aligned in a direction (in the embodiment, in the widthwise direction) that crosses with a direction (in the embodiment, in the upward/downward direction) in which the pair of lead terminals 6*a* and 6*b* and the fixing terminal 16 are aligned. Correspondingly, a pair of notch sections (positioning concave sections) 18*a* and 18*b* formed by cutting out central sections of both ends in the widthwise direction are provided in the circuit board 3.

When the circuit board 3 is attached to the board attachment section 4, first, thermal conductive grease (not shown) is disposed on a front surface of the board attachment section 4. Then, the pair of lead terminals 6*a* and 6*b* are made to penetrate through the pair of first hole sections 12*a* and 12*b*, respectively and the fixing terminal 16 is made to penetrate through the second hole section 13. In addition, the pair of positioning protrusions 17*a* and 17*b* are made to be engaged with a pair of notch sections 18*a* and 18*b*. Further, in this state, a back surface of the circuit board 3 is made to abut a front surface of the board attachment section 4 via thermal conductive grease. Further, the circuit board 3 is electrically insulated from the heat sink 5 in this state.

Next, from this state, the first land sections 14*a* and 14*b* around the first hole sections 12*a* and 12*b* and the lead terminals 6*a* and 6*b* are fixed through soldering. Similarly, the second land section 15 around the second hole section 13 and the fixing terminal 16 are fixed through soldering. Accordingly, the circuit board 3 can be attached to the front surface of the board attachment section 4.

In the light source unit 1 of the embodiment having the above-mentioned configuration, since the circuit board 3 is fixed to the board attachment section 4 through the above-mentioned soldering, the circuit board 3 can be stably attached to the board attachment section 4 of the socket main body 8 without using the adhesive agent like in the related art.

In addition, in the light source unit 1 of the embodiment, a process of fixing the lead terminals 6*a* and 6*b* and the first land sections 14*a* and 14*b* through soldering and a process of fixing the fixing terminal 16 and the second land section 15 through soldering can be performed by the same process.

Accordingly, in the light source unit 1 of the embodiment, since machining man-hours until the adhesive agent is cured is not necessary, as well as equipment, such as a curing oven or the like used in a curing process of an adhesive agent like in the related art, not being necessary, reduction in manufacturing costs is possible.

Further, the present invention is not particularly limited to the embodiment and various modifications may be made without departing from the scope of the present invention.

For example, while a configuration in which the single fixing terminal 16 is used is provided in the embodiment, a configuration in which a plurality of fixing terminals 16 are used may be provided. In addition, disposition of the fixing terminals 16 may be appropriately modified.

In addition, while a configuration in which the fixing terminal 16 is fixed through soldering is provided in the embodiment, in other cases, other fixing methods may be used. For example, the tip may be fixed through heat caulking using a protrusion protruding from the board attachment section 4 as the fixing terminal in a state in which the protrusion penetrating through the second hole section 13.

Further, while the case in which the present invention is applied to the tail lamp has been exemplarily described in the embodiment, when the tail lamp is configured, the present invention may be combined with another member such as an inner lens, an outer lens, a reflector, an extension, or the like, in addition to the light source unit 1.

In addition, in the lighting tool for a vehicle to which the present invention is applied, the present invention is not limited to the tail lamp and can be widely applied to a lighting tool for a vehicle such as a headlight (a headlamp) for a vehicle, a width indicator (a position lamp), an auxiliary headlight (a sub-headlamp), a front (rear) fog light (fog lamp), a daytime running (DRL) lamp, a lid lamp, a brake lamp (a stop lamp), a back lamp, a direction indicator (a blinker lamp), or the like.

In addition, in the light source unit to which the present invention is applied, in addition to the above-mentioned LED, for example, a light emitting element such as a laser diode (LD) or the like may be used. In addition, a color of light emitted from the light emitting element is not limited to the above-mentioned red light and may be appropriately changed to another light such as white light, orange light, or the like, according to a use of the light source unit. Further, the number of the light emitting elements is not limited to a plural number and may be one. In addition, disposition of the light emitting elements may be appropriately modified.

While preferred embodiments of the invention have been described and illustrated above, it should be understood that these are exemplary embodiments of the invention and are not to be considered as limiting. Additions, omissions, substitutions, and other modifications can be made without departing from the scope of the present invention. Accordingly, the invention is not to be considered as being limited by the foregoing description and is only limited by the scope of the appended claims.

What is claimed is:

1. A light source unit for a lighting tool for a vehicle comprising:

a circuit board on which a light emitting element is provided on a front surface thereof; and a socket main body having a board attachment section to which a rear surface of the circuit board is attached, a connector section electrically connected to the circuit board via a lead terminal, a front cylindrical section protruding forward from a central section of a front side of the socket main body and a through-hole formed at an inner side of the front cylindrical section, wherein a heat sink is disposed inside the through-hole, the board attachment section is provided at a tip portion of the front cylindrical section, the heat sink exposed from the through-hole and the lip portion of the from cylindrical section form a flat surface that is continuous with each other, a fixing terminal configured to fix the circuit board is provided at a region opposite to the lead terminal a bout the through-hole of the board attachment section, the circuit board has a first hole section into which the lead terminal is inserted and a second hole section into which the fixing terminal is inserted and is attached to the board attachment section by the lead terminal being fixed to a periphery of the first hole section through soldering and the fixing terminal being fixed to a periphery of the second hole section, and the beat sink and the rear surface of the board attachment section are fixed with each other in a state in which the heat sink and the board attachment section are electrically insulated.

2. The light source unit for a lighting tool for a vehicle according to claim 1, wherein the circuit board has a first land section around the first hole section, and the lead terminal is fixed to the first land section through soldering.

3. The light source unit for a lighting tool for a vehicle according to claim 2, wherein the circuit board has a second land section around the second hole section, and the fixing terminal is fixed to the second land section through soldering.

4. The light source unit for a lighting tool for a vehicle according to claim 2, wherein the first hole section and the second hole section are provided at positions so as to face each other with the light emitting element on the circuit board interposed therebetween.

5. The light source unit for a lighting tool for a vehicle according to claim 4, wherein the light emitting element is constituted by light emitting diode.

6. The light source unit for a lighting tool for a vehicle according to claim 1, wherein the first hole section and the second hole section are provided at positions so as to face each other with the light emitting element on the circuit board interposed therebetween.

7. A lighting tool for a vehicle comprising the light source unit for a lighting tool for a vehicle according to claim 1.

8. The lighting tool for a vehicle according to claim 7, wherein the light source unit for a lighting tool for a vehicle is detachably attached to a lighting body.

* * * * *